US007596336B2

(12) United States Patent
Fujii et al.

(10) Patent No.: US 7,596,336 B2
(45) Date of Patent: Sep. 29, 2009

(54) IMAGE FORMING APPARATUS FOR TRANSMITTING A CONTROL PROGRAM TO A PLURALITY OF SHEET PROCESSING DEVICES, AND AN IMAGE FORMING SYSTEM

(75) Inventors: Takayuki Fujii, Toshima-ku (JP); Manabu Yamauchi, Kashiwa (JP); Naoto Watanabe, Abiko (JP); Shunsuke Nishimura, Toride (JP); Yushi Oka, Abiko (JP); Toshiyuki Miyake, Toride (JP); Takashi Yokoya, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 138 days.

(21) Appl. No.: 11/693,575

(22) Filed: Mar. 29, 2007

(65) Prior Publication Data

US 2007/0253723 A1 Nov. 1, 2007

(30) Foreign Application Priority Data

Apr. 26, 2006 (JP) ..... 2006-122384

(51) Int. Cl.
*G03G 15/00* (2006.01)

(52) U.S. Cl. ..... 399/75

(58) Field of Classification Search ..... 399/75, 399/361, 76, 77; 270/58.14

See application file for complete search history.

(56) References Cited

U.S. PATENT DOCUMENTS

2005/0084277 A1* 4/2005 Kushida et al. ..... 399/81
2005/0220475 A1* 10/2005 Kasahara ..... 399/82

FOREIGN PATENT DOCUMENTS

JP 2003-345599 A 12/2003
JP 2004-110460 A 4/2004
JP 2004-259219 * 9/2004

* cited by examiner

*Primary Examiner*—David M Gray
*Assistant Examiner*—Billy J Lactaoen
(74) *Attorney, Agent, or Firm*—Canon U.S.A., Inc. I.P. Division

(57) ABSTRACT

An image forming apparatus is operable with a first sheet processing device and a second sheet processing device connected to the image forming apparatus via a network. The image forming apparatus includes a memory configured to store a control program for the first and second sheet processing devices; and a controller configured to exercise control so that the control program stored in the memory is transmitted to the first sheet processing device or the second sheet processing device. When the first and second sheet processing devices are of the same type, the controller transmits the control program to either the first sheet processing device or the second sheet processing device, and after completion of the transmission, the controller causes the sheet processing device to which the control program has been transmitted to transmit the control program to the other sheet processing device.

6 Claims, 8 Drawing Sheets

FIG. 8

| | FINISHER 400 | STACKER 500 | STACKER 600 |
|---|---|---|---|
| NETWORK ID | 10 | 2 | 1 |
| DEVICE TYPE | ACC1 | ACC2 | ACC2 |

PRIORITY

| | | | |
|---|---|---|---|
| LEVEL 1 | 2 | 1 | 1 |
| LEVEL 2 | 1 | 2 | 1 |

FIG. 9

| | FINISHER | SORTER 3 | SORTER 2 | SORTER 1 | STACKER 2 | STACKER 1 |
|---|---|---|---|---|---|---|
| NETWORK ID | 10 | 22 | 21 | 20 | 2 | 1 |
| DEVICE TYPE | ACC1 | ACC3 | ACC3 | ACC3 | ACC2 | ACC2 |

PRIORITY

| | | | | | | |
|---|---|---|---|---|---|---|
| LEVEL 1 | 3 | 1 | 1 | 1 | 2 | 2 |
| LEVEL 2 | 1 | 3 | 2 | 1 | 2 | 1 |

IMAGE FORMING APPARATUS FOR TRANSMITTING A CONTROL PROGRAM TO A PLURALITY OF SHEET PROCESSING DEVICES, AND AN IMAGE FORMING SYSTEM

BACKGROUND OF THE INVENTION

1. Field of the Invention

The present invention relates to an image forming apparatus, such as a copying machine or a laser beam printer. The present invention also relates to an image forming system including the image forming apparatus and sheet processing devices that carry out post-processing, such as sheet sorting or stapling.

2. Description of the Related Art

In an existing image forming system, usually, sheet processing devices individually have storage devices (ROMs) storing control programs, and the image forming system is controlled according to the control programs stored in the ROMs of the individual sheet processing devices.

For example, according to Japanese Patent Laid-Open No. 2003-345599, when control programs stored in the ROMs of a plurality of connected sheet processing devices are updated, control programs for updating the sheet processing devices are stored together in a hard disk or the like, and the sheet processing devices are updated sequentially.

However, when rewriting (downloading) of control programs is executed sequentially for a plurality of sheet processing devices connected to an image forming apparatus, until downloading for one sheet processing device is completed, downloading for another sheet processing device is not started. Thus, the downloading times for all the sheet processing devices directly add up, so that it takes a considerable time to finish downloading for an image forming system as a whole.

SUMMARY OF THE INVENTION

The present invention provides an image forming apparatus and an image forming system with which control programs for a plurality of sheet processing devices can be rewritten in a reduced time.

According to an aspect of the present invention, there is provided an image forming apparatus operable with a first sheet processing device and a second sheet processing device connected to the image forming apparatus via a network. The image forming apparatus includes a memory configured to store a control program for the first and second sheet processing devices; and a controller configured to exercise control so that the control program stored in the memory is transmitted to the first sheet processing device or the second sheet processing device. When the first sheet processing device and the second sheet processing device are sheet processing devices of the same type, the controller transmits the control program to either the first sheet processing device or the second sheet processing device, and after completion of the transmission, the controller causes the sheet processing device to which the control program has been transmitted to transmit the control program to the sheet processing device to which the control program has not been transmitted.

Further features of the present invention will become apparent from the following description of exemplary embodiments with reference to the attached drawings.

BRIEF DESCRIPTION OF THE DRAWINGS

FIG. 8 is a diagram for explaining priority assignment for the downloading operations of the entire image forming system shown in FIG. 5.

FIG. 9 is a diagram for explaining priority assignment for downloading operations in a case where sorters are provided in addition to the finisher and the stackers shown in FIG. 5.

DESCRIPTION OF THE EMBODIMENTS

Embodiments, features and aspects of the present invention will herein now be described in detail with reference to the drawings.

Figure 1:
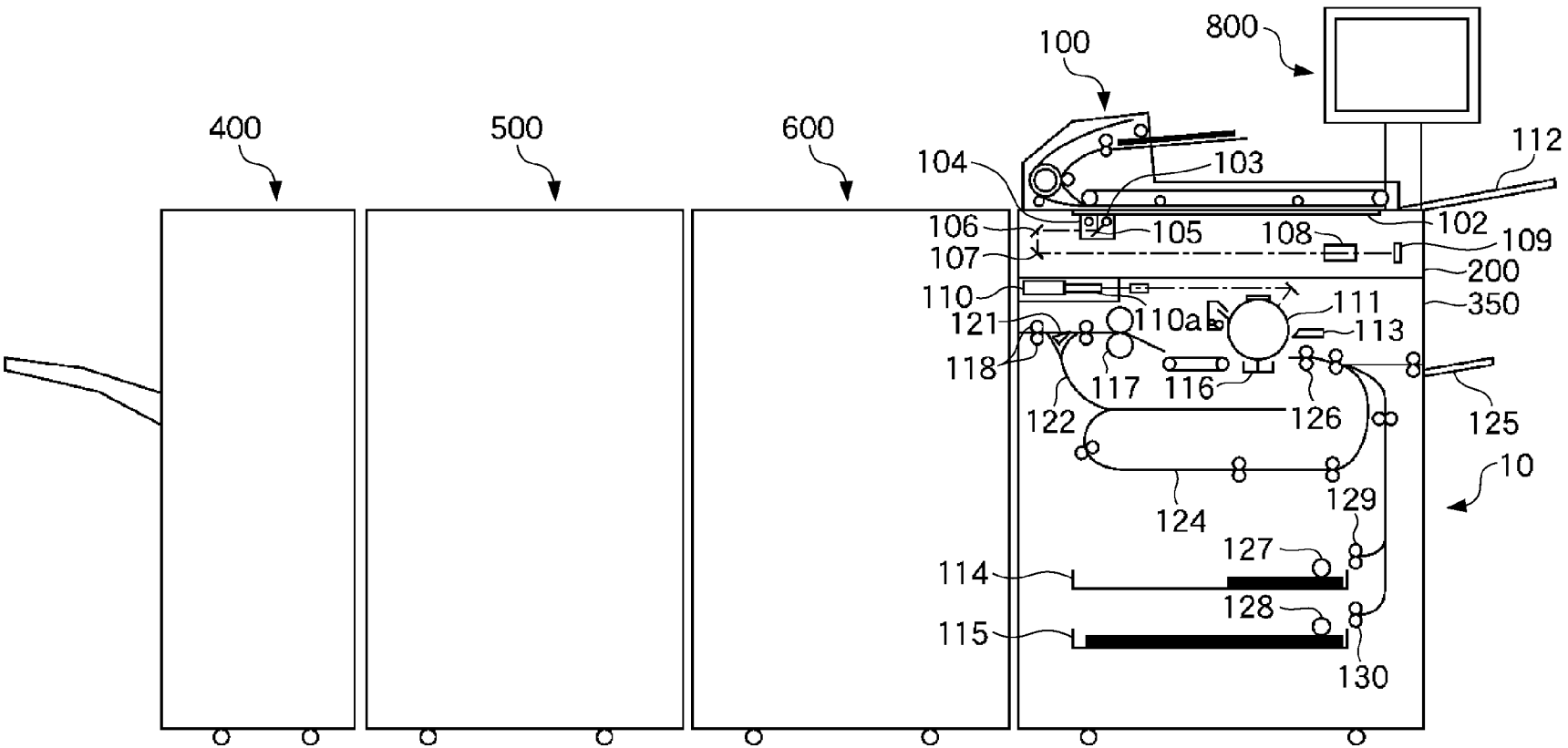
FIG. 1 is a diagram schematically showing the configuration of an example image forming system according to an exemplary embodiment of the present invention.

FIG. 1 is a diagram schematically showing an example configuration of an image forming system according to an embodiment of the present invention.

Referring to FIG. 1, the image forming system includes a main unit 10 of an image forming apparatus, and a plurality of sheet processing devices, namely, a finisher 400 and stackers 500 and 600.

The image-forming-apparatus main unit 10 has a document feeder 100 and an operation and display device 800 provided on upper parts thereof. The operation and display device 800 has a plurality of keys for setting of various functions relating to image formation, a display for displaying setting information, and so forth. The image-forming-apparatus main unit 10 includes an image reader 200 that reads an image from an original document, and a printer 350 that forms the image on a sheet.

Now, the configurations of the individual components will be described in detail. On the image reader 200 of the image-forming-apparatus main unit 10, the document feeder 100 is mounted. The document feeder 100 feeds an original document that is set face up on a document tray to the left side as viewed in FIG. 1, sequentially on a sheet-by-sheet basis from the first page, and via a curved path, delivers the document from the left side so that the document is transported over a platen glass 102 to the right side through a flow-reading position. Then, the document feeder 100 ejects the document to an external ejection tray 112.

When the document passes by the flow-reading position from left to right over the platen glass 102, an image of the document is read by a scanner unit 104 provided at a position corresponding to the flow-reading position. This reading method is referred to as document flow reading.

More specifically, when the document passes by the flow-reading position, a reading surface of the document is irradiated with light emitted from a lamp 103 of the scanner unit 104, and light reflected from the document is led to a lens 108 via mirrors 105, 106, and 107. Then, light having transmitted through the lens 108 forms an image on an imaging surface of an image sensor 109.

By transporting the document so that the document passes by the flow-reading position from left to right as described above, the document is read by carrying out scanning with a main scanning direction corresponding to a direction perpendicular to the document transporting direction and with a sub-scanning direction corresponding to the document transporting direction.

That is, when the document passes by the flow-reading position, an image of the document is read by the image sensor 109 line by line in the main scanning direction while transporting the document in the sub-scanning direction, thereby reading an image of the entire document.

The image that has been read optically is converted by the image sensor 109 into image data for output. The image data output from the image sensor 109 is input to an exposure controller 110 of the printer 350 as video signals.

Alternatively, it is possible to read an original document by transporting the document over the platen glass 102 by the document feeder 100 to a predetermined position and moving the scanner unit 104 from left to right to scan the document fixed at the position. This reading method is referred to as document fixed reading.

When an original document is read without using the document feeder 100, first, a user pulls up the document feeder 100 and places the document on the platen glass 102, and the scanner unit 104 is moved from left to right to scan the document. That is, when an original document is read without using the document feeder 100, the document is read by document fixed reading.

The exposure controller 110 of the printer 350 modulates a laser beam on the basis of the video signals input from the image reader 200, and outputs the modulated laser beam. The laser beam scans and irradiates the surface of a photosensitive drum 111 via a polygon mirror 110*a*. Thus, on the photosensitive drum 111, an electrostatic latent image corresponding to the laser beam is formed.

The exposure controller 110 outputs a laser beam so that a correct image (not a mirror image) is formed when an original document is read by document fixed reading. The electrostatic latent image formed on the photosensitive drum 111 is visualized in the form of a toner image using toner supplied from a developing unit 113.

A sheet that is picked up by a pickup roller 127 or a pickup roller 128 from an upper cassette 114 or a lower cassette 115 provided in the printer 350 is transported to a registration roller 126 by a feeding roller 129 or a feeding roller 130.

The registration roller 126 is driven at an arbitrary timing when the leading end of the sheet has reached the registration roller 126, and the sheet is transported to a region between the photosensitive drum 111 and a transferring unit 116 at a timing synchronized with the start of irradiation with the laser beam. The toner image formed on the photosensitive drum 111 is transferred onto the sheet by the transferring unit 116.

The sheet carrying the toner image transferred thereto is transported to a fixing unit 117. The fixing unit 117 fixes the toner image on the sheet by applying heat and pressure to the sheet. The sheet having passed through the fixing unit 117 is ejected from the printer 350 to a puncher provided outside the image-forming-apparatus main unit 10, via a flapper 121 and an ejection roller 118.

When the sheet is to be ejected with the image forming surface of the sheet facing down, the sheet having passed through the fixing unit 117 is led into an inverting path 122 by a switching operation of the flapper 121. Then, when the trailing end of the sheet has passed by the flapper 121, the sheet is switched back so that the sheet is ejected out of the printer 350 by the ejection roller 118.

The manner of sheet ejection described above is referred to as inverted sheet ejection. The inverted sheet ejection is carried out when images are formed sequentially from the first page, for example, when images read using the document feeder 100 are formed or images output from a computer are formed, so that ejected sheets are arranged in an appropriate order.

When a relatively hard sheet, such as a sheet for an overhead projector (OHP), is fed from a manual feeding unit 125 so that an image is formed on the sheet, without leading the sheet into the inverting path 122, the sheet is ejected by the ejection roller 118 with the image forming surface of the sheet facing up.

When a double-side recording mode is "ON" so that images are formed on either surface of a sheet, the sheet is led into the inverting path 122 by a switching operation of the flapper 121 and is then transported to a double-side transporting path 124. Then, the sheet led into the double-side transporting path 124 is again fed to the region between the photosensitive drum 111 and the transferring unit 116, at a timing synchronized with the start of irradiation with a laser beam as described earlier. The sheet ejected from the printer 350 of the image-forming-apparatus main unit 10 is delivered to the stacker 600.

Figure 2:
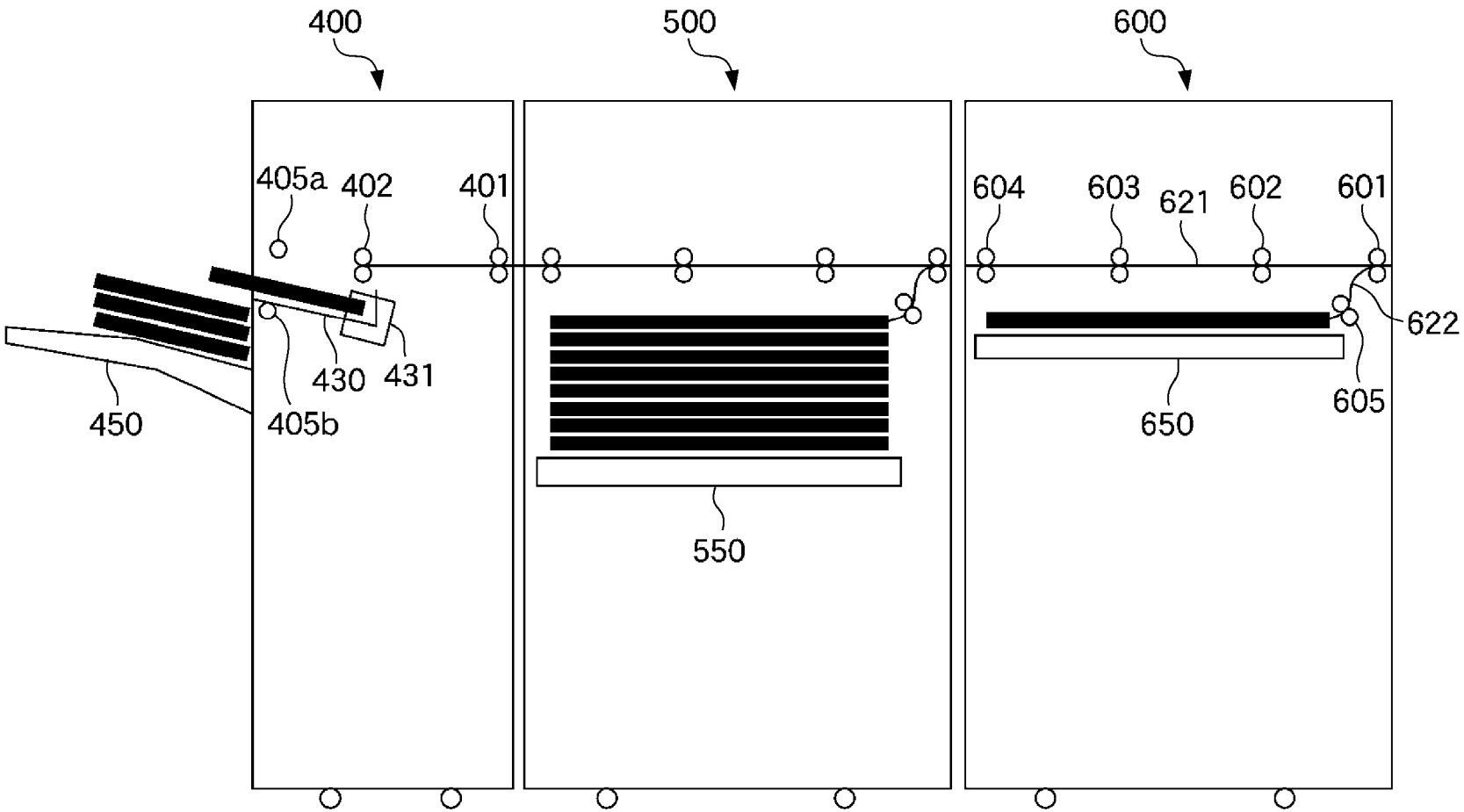
FIG. 2 is a diagram showing example details of the configurations of sheet processing devices shown in FIG. 1.

FIG. 2 is a diagram showing example details of the configuration of the sheet processing devices 400, 500, and 600 shown in FIG. 1.

Referring to FIG. 2, the stacker 600 receives a sheet ejected from the image-forming-apparatus main unit 10. When the ejection destination of the sheet is the stacker 600 itself, the sheet transported by a transporting roller 601 is forwarded into a stack path 622 by a switching operation of a flapper (not shown), and the sheet is then ejected to an ejection tray 650 by an ejection roller 605. The ejection roller 650 is controlled to move up and down so that the height of sheets stacked on the ejection tray 650 is maintained constant relative to the ejection roller 605.

On the other hand, when the ejection destination of the sheet ejected from the image-forming-apparatus main unit 10 is the stacker 500 or the finisher 400 located downstream of the stacker 600, the sheet transported by the transporting roller 601 is forwarded into a transporting path 621 by an operation of the flapper (not shown). Then, the sheet is transported by transporting rollers 602, 603, and 604 and is thereby passed to the stacker 500.

The stacker 500 is configured the same as the stacker 600. Similarly to the stacker 600, the stacker 500 ejects a sheet transported thereto to an ejection tray 550 and stacks the sheet on the ejection tray 550 or passes the sheet to the finisher 400 located downstream thereof, according to the ejection destination of the sheet.

The finisher 400 receives a sheet ejected from the stacker 500, and ejects the sheet to a processing tray 430 by transporting rollers 401 and 402. Sheets received by the finisher 400 are sequentially stacked on the processing tray 430 sheet by sheet, and the sheets are aligned by a sheet aligner (not shown) with respect to both the sheet transporting direction and the direction perpendicular to the sheet transporting direction. Then, the sheets are ejected to a stack tray 450 together as a bundle of sheets.

The bundle of sheets is placed between bundle ejection rollers 405*a* and 405*b*, and is ejected from the processing tray 430 to the stack tray 450 by rotation of the bundle ejecting rollers 405*a* and 405*b*. The bundle ejection roller 405*a* is controlled so that it is moved down when ejecting a bundle of sheets and is otherwise maintained at a lifted position.

The processing tray 430 has a stapler 431. When a staple mode is ON for post-processing (sheet processing), the bundle of sheets is stapled by the stapler 431 and is then ejected from the processing tray 430 and the stack tray 450.

The stack tray 450 is controlled to move up and down so that the height of sheets stacked on the stack tray 450 is maintained constant relative to an ejection slot of the processing tray 430.

Figure 3:
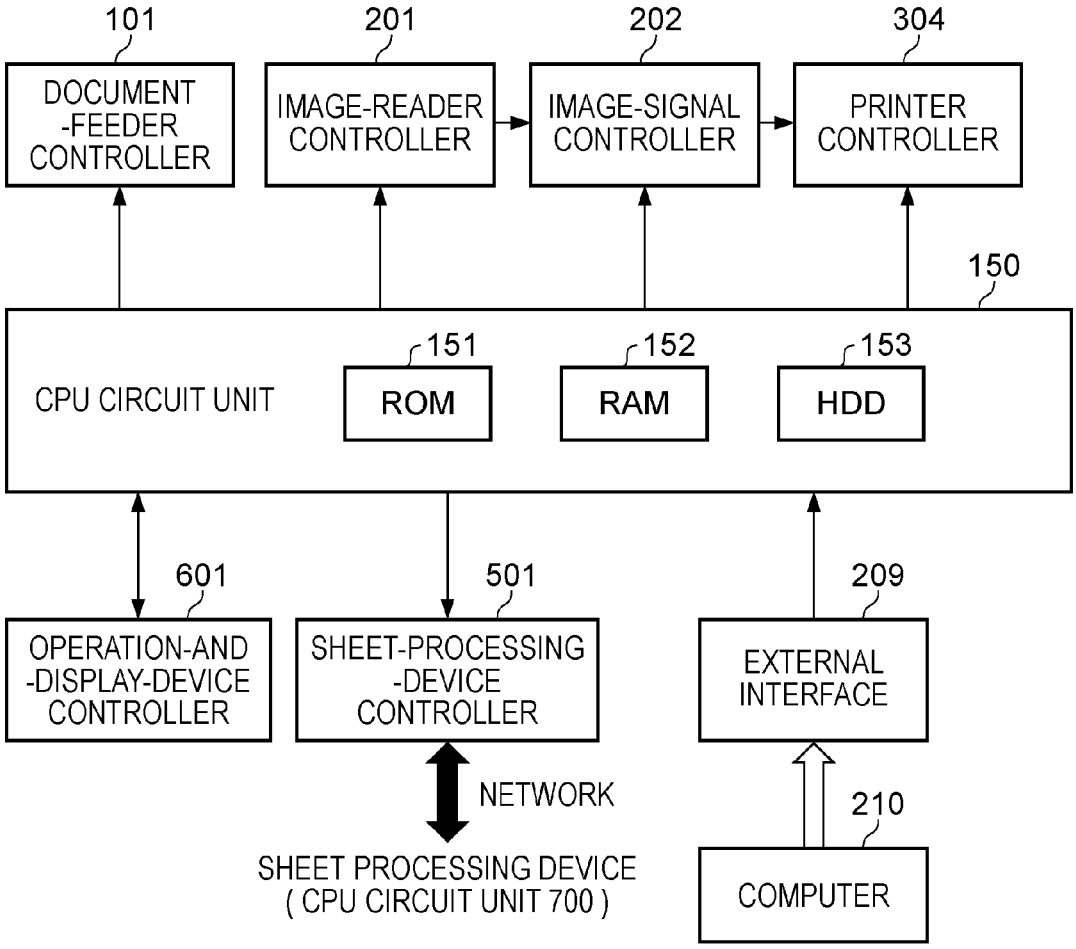
FIG. 3 is a block diagram schematically showing an example configuration of a controller that controls a main unit of an image forming apparatus shown in FIG. 1.

FIG. 3 is a block diagram schematically showing an example configuration of a controller that controls the image-forming-apparatus main unit 10 shown in FIG. 1.

Referring to FIG. 3, the controller includes a CPU circuit unit 150. The CPU circuit unit 150 includes a central processing unit (CPU) (not shown), a read-only memory (ROM) 151, a random access memory (RAM) 152, and a hard disk drive (HDD) 153.

The CPU circuit unit 150 controls a document-feeder controller 101, an image-reader controller 201, an image-signal controller 202, an external interface 209, a printer controller 304, a sheet-processing-device controller 501, and an operation-and-display-device controller 601 according to programs stored in the ROM 151. The RAM 152 temporarily stores control data, and is used as a work area for executing operations for exercising control. The HDD 153 allows storing various types of data in large volume, such as image data.

The document-feeder controller 101 controls the operation of the document feeder 100 according to instructions from the CPU circuit unit 150. The image-reader controller 201 controls the operations of the scanner unit 104, the image sensor 109, and so forth to transfer analog image signals output from the image sensor 109 to the image-signal controller 202.

The image-signal controller 202 converts the analog image signals transferred from the image sensor 109 into digital signals, executes processing on the digital signals to convert the digital signals into video signals, and outputs the video signals to the printer controller 304. This operation by the image-signal controller 202 is controlled by the CPU circuit unit 150. The printer controller 304 drives the exposure controller 110 on the basis of the video signals input thereto.

The sheet-processing-device controller 501 generally controls the finisher 400, the stacker 500, and the stacker 600 by carrying out communications via a network on the basis of signals supplied from the CPU circuit unit 150 in accordance with various post-processing settings specified via the operation and display device 800.

The operation-and-display-device controller 601 exchanges information between the operation and display device 800 and the CPU circuit unit 150. The operation and display device 800 outputs key signals corresponding to key operations to the CPU circuit unit 150, and displays information corresponding to signals supplied from the CPU circuit unit 150 on a display.

The CPU circuit unit 150 receives input of instructions from an external computer 210 via the external interface 209, such as a print instruction.

Figure 4:
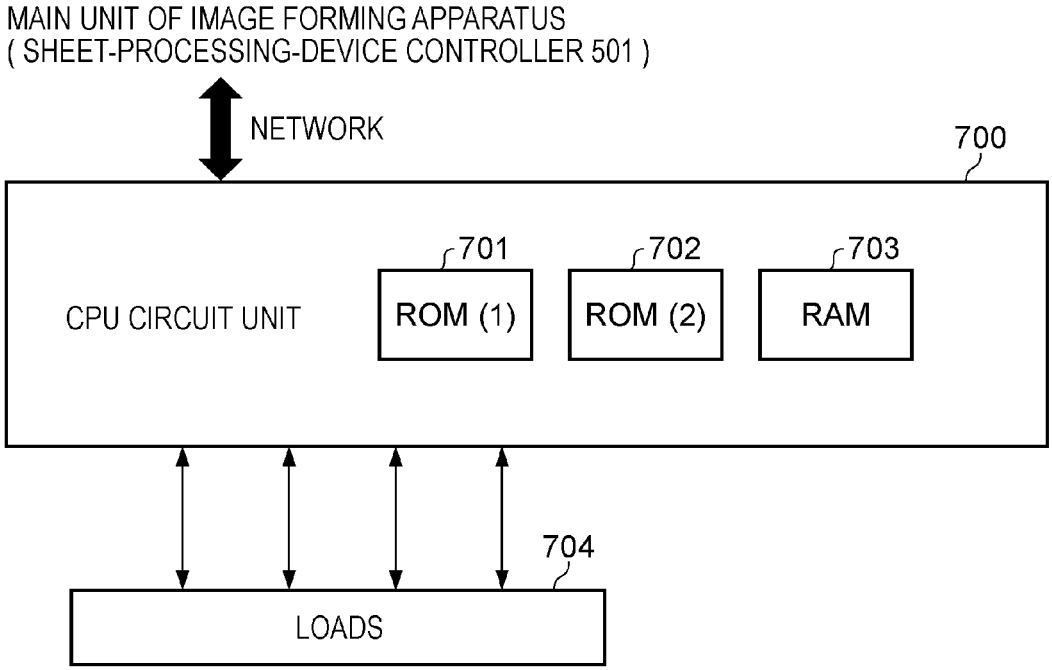
FIG. 4 is a block diagram schematically showing an example configuration of a controller that controls a finisher and stackers shown in FIG. 1.

FIG. 4 is a block diagram schematically showing an example configuration of a controller that controls the sheet processing devices shown in FIG. 1, i.e., the finisher 400 and the stackers 500 and 600.

Referring to FIG. 4, the controller includes a CPU circuit unit 700. The CPU circuit unit 700 includes a CPU (not shown), a ROM (1) 701, a ROM (2) 702, and a RAM 703.

The ROM (1) 701 stores a download controlling program, which will be described later. The ROM (2) 702 stores control programs for generally controlling various loads 704, such as a motor and a sensor.

The RAM 703 temporarily stores control data, and is used as a work area for executing operations for exercising control. Usually, only the ROM (2) 702 is used for operation when downloading is not taking place.

The specific types of the loads 704, such as a motor and a sensor, differ between the finisher 400 and the stackers 500 and 600. However, the ROM (1) 701, the ROM (2) 702, and the RAM 703 of the CPU circuit unit 700 and an interface for communications with the sheet-processing-device controller 501 are configured the same among the finisher 400 and the stackers 500 and 600.

Figure 5:
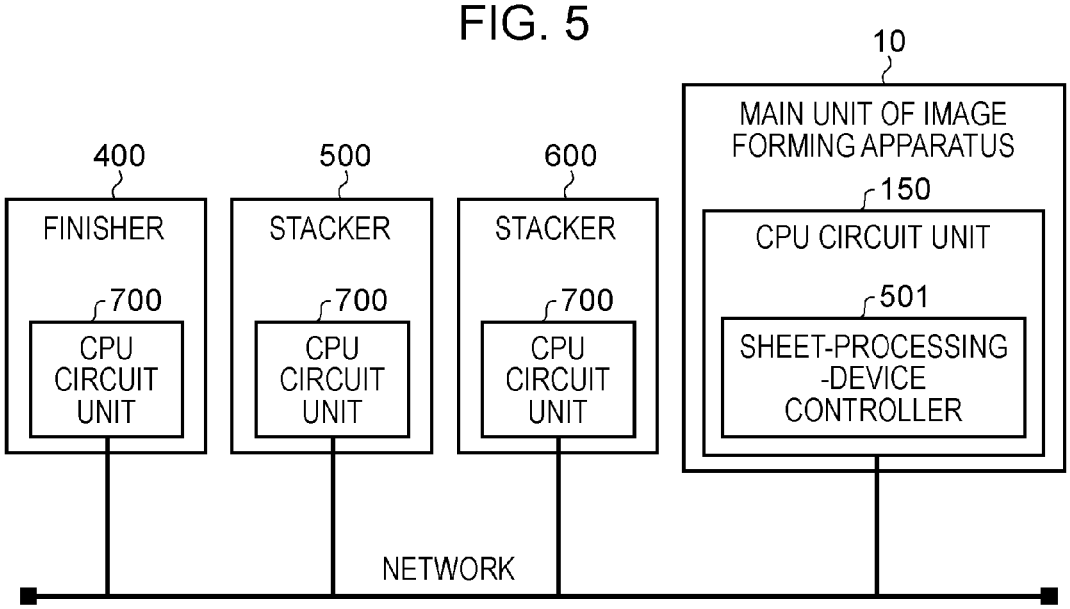
FIG. 5 is a diagram schematically showing an example network configuration of the image forming system shown in FIG. 1.

FIG. 5 is a diagram schematically showing an example network configuration of the image forming system shown in FIG. 1.

Referring to FIG. 5, the sheet-processing-device controller 501 of the CPU circuit unit 150, configured as shown in FIG. 3, is connected via a network to the CPU circuit units 700 of the finisher 400 and the stackers 500 and 600, configured as shown in FIG. 4.

Now, a method of rewriting control programs stored in the ROMs (2) 702 of the finisher 400 and the stackers 500 and 600 will be described.

Figure 6:
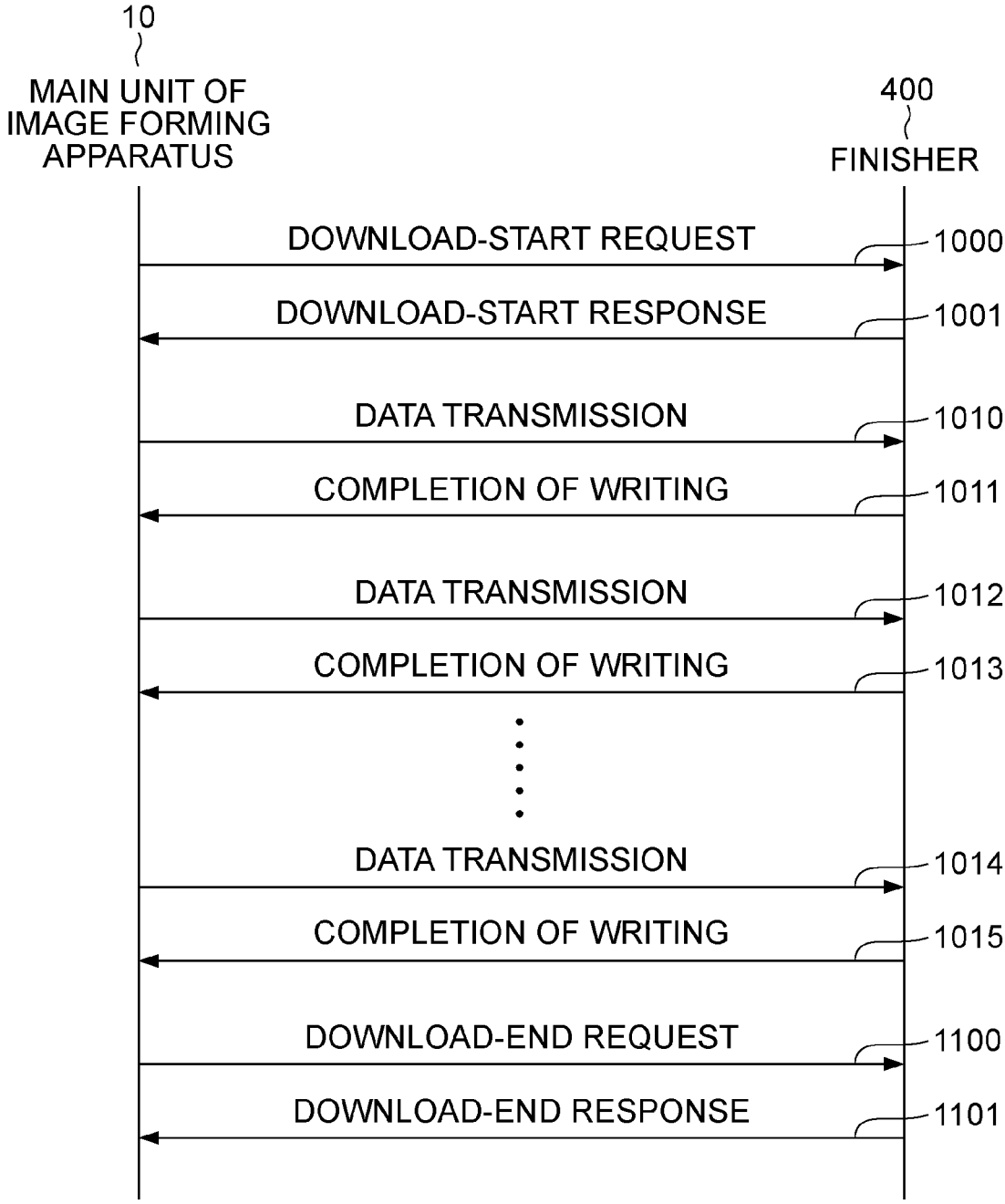
FIG. 6 is a diagram for explaining a downloading operation of the finisher shown in FIG. 5.

First, a case where only a control program for the finisher 400 is rewritten will be described with reference to FIG. 6.

A control program (hereinafter referred to as firmware) for the finisher 400 is transferred from the computer 210 to the image-forming-apparatus main unit 10 via the external interface 209. The firmware transferred via the external interface 209 is first stored in the HDD 153 of the CPU circuit unit 150. When the firmware has been stored in the HDD 153, the sheet-processing-device controller 501 and the CPU circuit unit 700 of the finisher 400 start carrying out communications via the network.

First, the finisher 400 is notified that downloading of the firmware starts (1000). At this time, the finisher 400 is executing operations, including communications, according to the firmware stored in the ROM (2) 702. Thus, in order to prepare for the rewriting of the firmware stored in the ROM (2) 702, the finisher 400 quits exercising control according to the firmware stored in the ROM (2) 702 and switches to control according to a program stored in the ROM (1) 701.

According to the program stored in the ROM (1) 701, first, data stored in the ROM (2) 702 is deleted. When all the data stored in the ROM (2) 702 has been deleted, preparation for writing to the ROM (2) 702 is finished. Then, a download-start response is issued to the image-forming-apparatus main unit 10 (1001).

Then, the image-forming-apparatus main unit 10 starts transmission of the firmware for the finisher 400, stored in the HDD 153 (1010). At this time, data of the firmware is transmitted in blocks of a predetermined size.

Upon receiving the data, the finisher 400 writes the received data to the ROM (2) 702. Upon completion of the writing, the finisher 400 issues a notification of completion of writing to the image-forming-apparatus main unit 10 (1011).

The firmware that is written to the ROM (2) 702 is transmitted to the finisher 400 in segments, so that it takes a plurality of times of transmission. Thus, the data transmission and notification of completion of writing are repeated a number of times as needed (1012, 1013). After the transmission of the last segment of data (1014) and notification of completion of writing (1015), a download-completion request is issued (1100).

In response to the download-completion request (1100), the finisher 400 quits exercising control according to the program stored in the ROM (1) 701, and switches to control according to the firmware that has been written to the ROM (2) 702. Then, the finisher 400 issues a download-completion response to the image-forming-apparatus main unit 10 (1101).

Next, a case where firmware for the finisher 400 and the stackers 500 and 600 is rewritten will be described with reference to FIG. 7. The stacker 500 and the stacker 600 are configured the same, so that program data stored in the ROM (1) 701 and the ROM (2) 702 of the CPU circuit unit 700 is the same between the stacker 500 and the stacker 600.

Similarly to the case described above where only the firmware for the finisher 400 is rewritten, firmware for the finisher 400 and the stacker 500 is transferred from the computer 210 to the image-forming-apparatus main unit 10 via the external interface 209 and is then stored in the HDD 153. At this time, since the same firmware is commonly used for the stacker 500 and the stacker 600, only one set of firmware for the stackers 500 and 600 is transferred to and stored in the HDD 153.

When the firmware data for the finisher 400 and the firmware data for the stackers 500 and 600 have been stored in the HDD 153, the image-forming-apparatus main unit 10 determines priority as to the order of sheet processing devices in rewriting firmware.

Also, simultaneously method of determining priority will be described with reference to FIG. 8. As shown in FIG. 8, the image-forming-apparatus main unit 10 stores therein system configuration information including network IDs and device type information of the individual sheet processing devices connected thereto. Each of the sheet processing devices is assigned a unique network ID so that the network ID can be used for identifying the sheet processing device when communications are carried out.

The device type information is used to distinguish the types of sheet processing devices, such as the finisher 400 and the stackers 500 and 600. Thus, the same device type information is assigned to sheet processing devices of the same device type, such as the stacker 500 and the stacker 600. That is, it is possible that the same device type information is commonly used for multiple sheet processing devices on a network connecting the image-forming-apparatus main unit 10 with various sheet processing devices. The network ID and the device type information are assigned in advance when the sheet processing devices are installed.

First, it is checked whether any set of multiple sheet processing devices having the same device type information exists. Since the device type information of the finisher 400 is defined as ACC1 and the device type information of the stackers 500 and 600 is defined as ACC2, it is understood from the system configuration information that ACC2 is assigned to multiple sheet processing devices.

Thus, priority setting level 1 based on the device type information is defined so that ACC2 has a higher priority than ACC1. Then, priority setting level 2 is defined for the stackers 500 and 600 having the same device type information ACC2 so that a higher priority is assigned to the stacker with a smaller value of the network ID. This concludes the priority assignment, and then firmware of the individual sheet processing devices is rewritten.

Although the priority setting level 2 is defined so that a higher priority is assigned to a sheet processing device with a smaller value of the network ID in this embodiment, the priority setting level 2 may be defined so that the order of priority is the opposite. Furthermore, any criterion may be used for the priority setting level 2 as long as different priorities are assigned to individual sheet processing devices.

According to the priority assignment described above, two stackers with the highest priority exist according to the priority setting level 1, of which the stacker 600 has a higher priority according to the priority setting level 2. Thus, the image-forming-apparatus main unit 10 executes processing for the stacker 600.

The processing between the image-forming-apparatus main unit 10 and the stacker 600 is executed similarly to the case where only the firmware for the finisher 400 is rewritten. More specifically, the image-forming-apparatus main unit 10 issues a download-start request to the stacker 600 (2000), and the stacker 600 quits exercising control according to a program stored in the ROM (2) 702. Then, the stacker 600 switches to control according to a program stored in the ROM (1) 701, and deletes all the data stored in the ROM (2) 702. Then, the stacker 600 issues a download-start response to the image-forming-apparatus main unit 10 (2001).

Then, the image-forming-apparatus main unit 10 starts transmission of the firmware for the stacker 600, stored in the HDD 153 (2010). Then, the stacker 600 writes received data to the ROM (2) 702. Upon completion of the writing, the stacker 600 issues a notification of completion of writing to the image-forming-apparatus main unit 10 (2011).

The data transmission and notification of completion of writing are repeated a number of times as needed (2012, 2013). After the transmission of the last segment of data (2014) and notification of completion of writing (2015), a download-completion request is issued (2100).

In response to the download-completion request (2100), the stacker 600 quits exercising control according to the program stored in the ROM (1) 701, and switches to control according to the firmware that has been written to the ROM (2) 702. Then, the stacker 600 issues a download-completion response to the image-forming-apparatus main unit 10 (2101).

Then, the image-forming-apparatus main unit 10 proceeds to downloading to the stacker 500, which has the same priority according to the priority setting level 1 as the stacker 600 for which downloading has been finished. More specifically, the image-forming-apparatus main unit 10 issues a download-execution request so that the stacker 600 executes processing for downloading to the stacker 500 (2200). The processing executed by the stacker 600 in response to the download-execution request will be described later.

Then, the image-forming-apparatus main unit 10 proceeds to downloading to the finisher 400, which has the next priority according to the priority setting level 1.

The downloading to the finisher 400 is carried out similarly to the downloading operations described above. More specifically, the image-forming-apparatus main unit 10 issues a download-start request to the finisher 400 (2300), and receives a download-start response from the finisher 400 (2301). Then, the image-forming-apparatus main unit 10 repeats transmission of firmware data (2310 to 2315). Then, the image-forming-apparatus main unit 10 issues a download-completion request (2400) and receives a download-completion response (2401). This concludes downloading to the finisher 400.

The stacker 600, upon receiving the download-execution request for executing processing for downloading to the stacker 500, recognizes that the firmware of the stacker 600 is to be downloaded to the stacker 600. Thus, the stacker 600 carries out communications (2500 to 2601) similarly to the communications carried out by the image-forming-apparatus main unit 10 for downloading to the stacker 600, so that the firmware is downloaded to the stacker 500.

At this time, in contrast to the image-forming-apparatus main unit 10 transmitting data of the firmware stored in the HDD 153, the stacker 600 transmits data to the stacker 500 with reference to the data stored in the ROM (2) 702 of the stacker 600 itself. That is, the reference source of data differs.

Upon receiving the download-completion response from the stacker 500 (2601), the stacker 600 issues a download-execution response to the image-forming-apparatus main unit 10 (2700).

On the basis of the completion of downloading to the finisher 400, and the notification by the stacker 600 of the completion of downloading to the stacker 500, the image-forming-apparatus main unit 10 can recognize that downloading to all the sheet processing devices has been finished.

Figure 7:
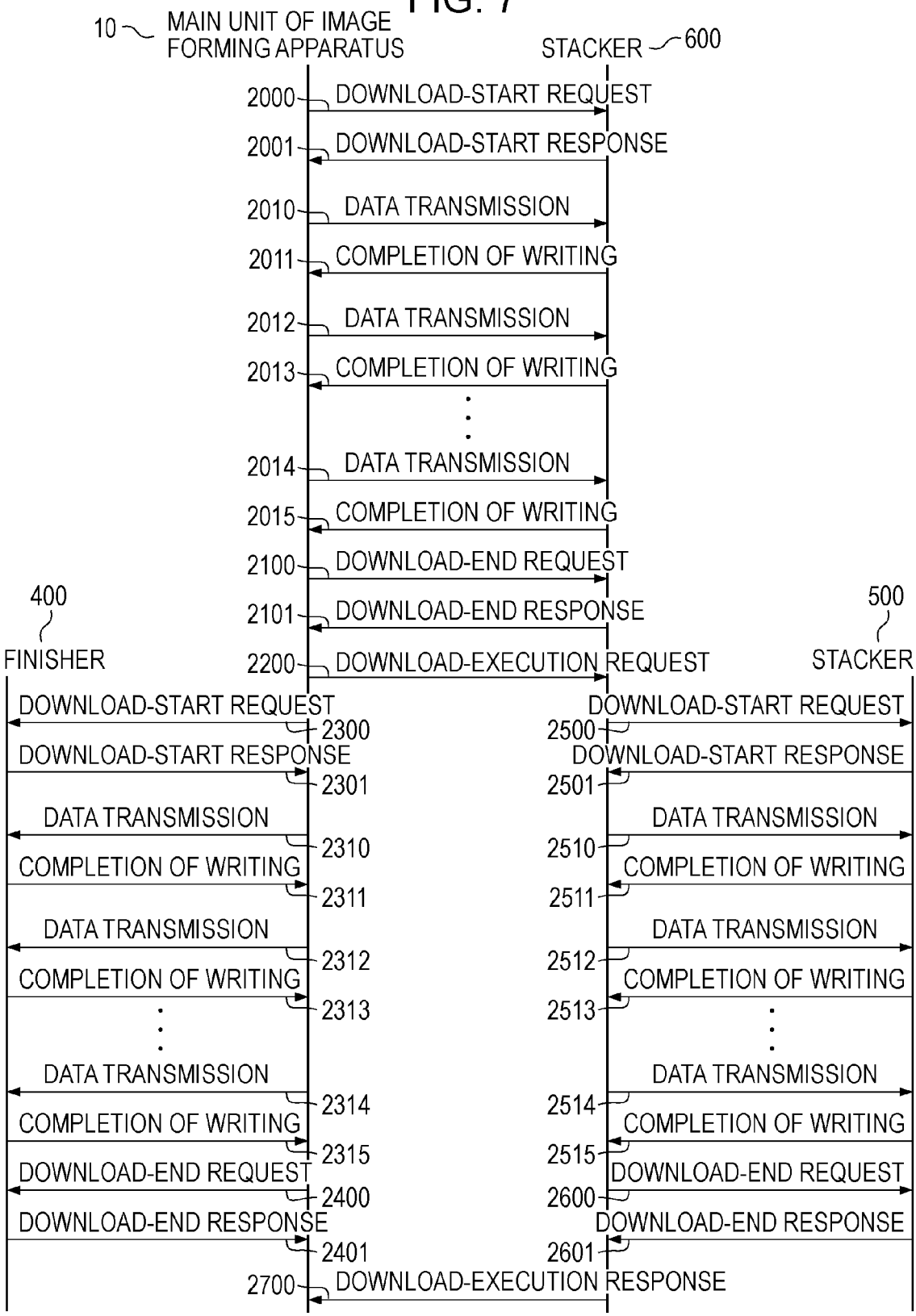
FIG. 7 is a diagram for explaining downloading operations of the entire image forming system shown in FIG. 5.

According to the processing shown in FIG. 7, the image-forming-apparatus main unit 10 and the stacker 600 allow control programs to be downloaded to the finisher 400 and the stacker 500 in parallel. Thus, downloading time can be reduced.

As another example, a case where two stackers, three sorters, and one finisher are connected as sheet processing devices, as shown in FIG. 9, will be considered.

Each of the sheet processing devices has a unique network ID assigned thereto. Furthermore, as device type information, ACC1 is assigned to the finisher, ACC2 is assigned to the stackers, and ACC3 is assigned to the sorters.

Priority setting level 1 is defined so that priority becomes higher as the number of sheet processing devices having the same device type information becomes larger. In this case, the order of priority is the sorters, the stackers, and the finisher, from highest to lowest. Furthermore, for each set of sheet processing devices having the same device type information, priority setting level 2 is defined so that a sheet processing device with a smaller network ID has a higher priority.

Figure 10:
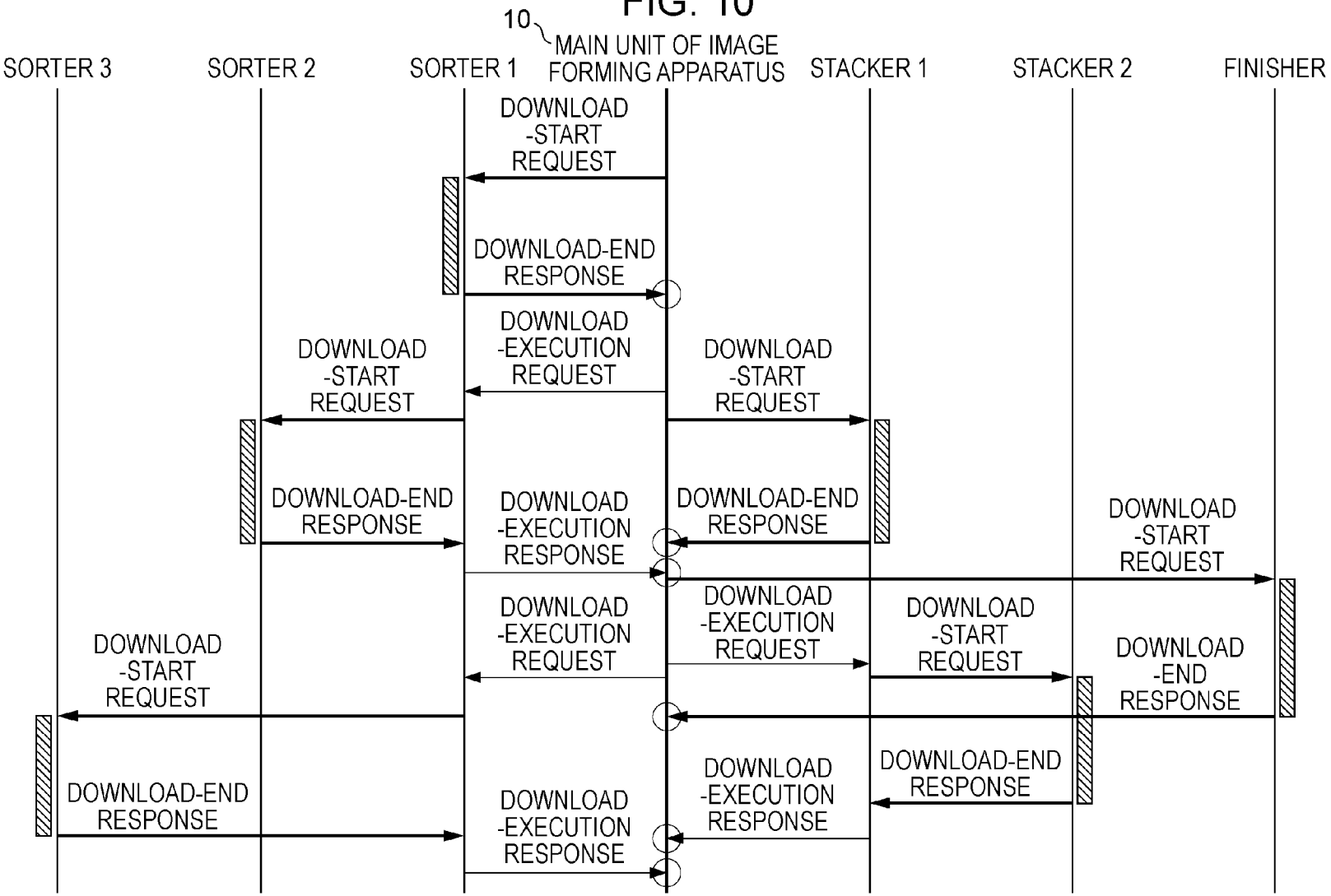
FIG. 10 is a diagram for explaining downloading operations that are executed according to the priority assignment shown in FIG. 9.

FIG. 10 shows the overall operation in this example. Referring to FIG. 10, according to the priority assignment described above, first, downloading from the image-forming-apparatus main unit 10 to the sorter 1 is executed. Then, downloading from the image-forming-apparatus main unit 10 to the stacker 1 and downloading from the sorter 1 to the sorter 2 are executed.

Then, upon completion of downloading to the stacker 1, downloading from the image-forming-apparatus main unit 10 to the finisher and downloading from the stacker 1 to the stacker 2 are executed. Furthermore, upon completion of downloading to the sorter 2, downloading from the sorter 1 to the sorter 3 is executed.

As described above, with the image forming system according to this embodiment, rewriting of control programs is executed in parallel. Thus, control programs for a plurality of sheet processing devices can be rewritten in a reduced time.

Although the stackers 500 and 600 and the finisher 400 are connected to the image-forming-apparatus main unit 10 in the embodiment described above, for example, the finisher 400 may be omitted. In this case, the image-forming-apparatus main unit 10 can start activating the printer 350 as soon as downloading to the stacker 600 is finished. Thus, the printer 350 can be activated quickly.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2006-122384 filed Apr. 26, 2006, which is hereby incorporated by reference herein in its entirety.

What is claimed:

1. An image forming apparatus operable with a first sheet processing device, a second sheet processing device and a third sheet processing device connected to the image forming apparatus via a network, the image forming apparatus comprising:

a memory configured to store a control program for the first, second, and third sheet processing devices; and a controller configured to perform control so that the control program stored in the memory is transmitted to the first sheet processing device, the second sheet processing device or the third sheet processing device;

wherein, when the first sheet processing device and the second sheet processing device are sheet processing devices of the same type, the controller transmits the control program to the first sheet processing device, and after completion of the transmission, the controller causes the first sheet processing device to transmit the control program to the second sheet processing device while the controller transmits the control program to the third sheet processing device.

2. The image forming apparatus according to claim 1, wherein the first and second sheet processing devices are stackers, and the third sheet processing device is a finisher.

3. The image forming apparatus according to claim 1, wherein the controller rewrites the control program in descending order of priority assigned in advance to the individual sheet processing devices.

4. The image forming apparatus according to claim 3, wherein the controller sets a highest priority to sheet processing devices of a type with a largest number of sheet processing devices among types of sheet processing devices connected.

5. The image forming apparatus according to claim 1, wherein the control program stored in the memory is downloaded from an external host apparatus.

6. An image forming system comprising:

an image forming apparatus;

a first sheet processing device;

a second sheet processing device; and a third sheet processing device;

wherein the image forming apparatus, the first sheet processing device, the second sheet processing device and the third sheet processing device are connected to each other via a network;

the image forming apparatus further including, a memory configured to store a control program for the first, second and third sheet processing devices; and a controller configured to exercise control so that the control program stored in the memory is transmitted to either the first sheet processing device, the second sheet processing device or the third sheet processing device;

wherein, when the first sheet processing device and the second sheet processing device are sheet processing devices of the same type, the controller transmits the control program to the first sheet processing device, and after completion of the transmission, the controller causes the first sheet processing device to transmit the control program to the second sheet processing device while the controller transmits the control program to the third sheet processing device.

* * * * *